US006281150B1

(12) United States Patent
Groshens

(10) Patent No.: US 6,281,150 B1
(45) Date of Patent: Aug. 28, 2001

(54) TEXTILE SUPPORT FOR REINFORCING AN ITEM OF CLOTHING OR PIECES OF CLOTHING

(75) Inventor: Pierrot Groshens, Flamicourt (FR)

(73) Assignee: Lainiere de Picardie (FR)

( * ) Notice: Subject to any disclaimer, the term of this patent is extended or adjusted under 35 U.S.C. 154(b) by 0 days.

(21) Appl. No.: 09/251,477

(22) Filed: Feb. 17, 1999

(30) Foreign Application Priority Data

Feb. 20, 1998 (FR) ..... 98 02080

(51) Int. Cl.[7] ..... D04B 1/00; B32B 5/26

(52) U.S. Cl. ..... 442/314; 442/312; 442/313; 442/319; 66/190; 66/192

(58) Field of Search ..... 442/312, 313, 442/314, 319; 66/190, 192

(56) References Cited

U.S. PATENT DOCUMENTS

| | | | | |
|---|---|---|---|---|
| 3,992,904 | | 11/1976 | Webb et al. | 66/190 |
| 4,229,953 | | 10/1980 | Warsop | 66/194 |
| 4,696,850 | * | 9/1987 | Jost et al. | 428/197 |
| 5,065,599 | | 11/1991 | Groshens | 66/84 |
| 5,241,709 | * | 9/1993 | Kufner et al. | 2/97 |
| 5,552,206 | | 9/1996 | Knoke et al. | 428/102 |

FOREIGN PATENT DOCUMENTS

| | | | |
|---|---|---|---|
| 42 18 234 A1 | 12/1993 | (DE) | D04B/21/14 |
| 0 369 046 A1 | 11/1988 | (EP) | D04B/21/14 |
| 2 645 180 | 3/1989 | (FR) | D04H/5/02 |

OTHER PUBLICATIONS

Patent Abstracts of Japan; Publication No.: 08081866; Publication Date: Mar. 26, 1996; Application Date: Sep. 12, 1994; Application No.: 06244650; Applicant: Nippon Mayer KK.

French Search Report, FA 554029, FR 9802080, Barathe, R., Nov. 12, 1998.

* cited by examiner

*Primary Examiner*—Elizabeth M. Cole
*Assistant Examiner*—Ula C. Ruddock
(74) *Attorney, Agent, or Firm*—George T. Marcou; Kilpatrick Stockton LLP

(57) ABSTRACT

The invention relates to a textile support (1) for reinforcing clothing or pieces of clothing, in the form of a layer of nonwoven textile (2) reinforced by at least one warp knit fabric (3) having floats between the columns (5) of stitches.

27 Claims, 5 Drawing Sheets

TEXTILE SUPPORT FOR REINFORCING AN ITEM OF CLOTHING OR PIECES OF CLOTHING

Figure 1:
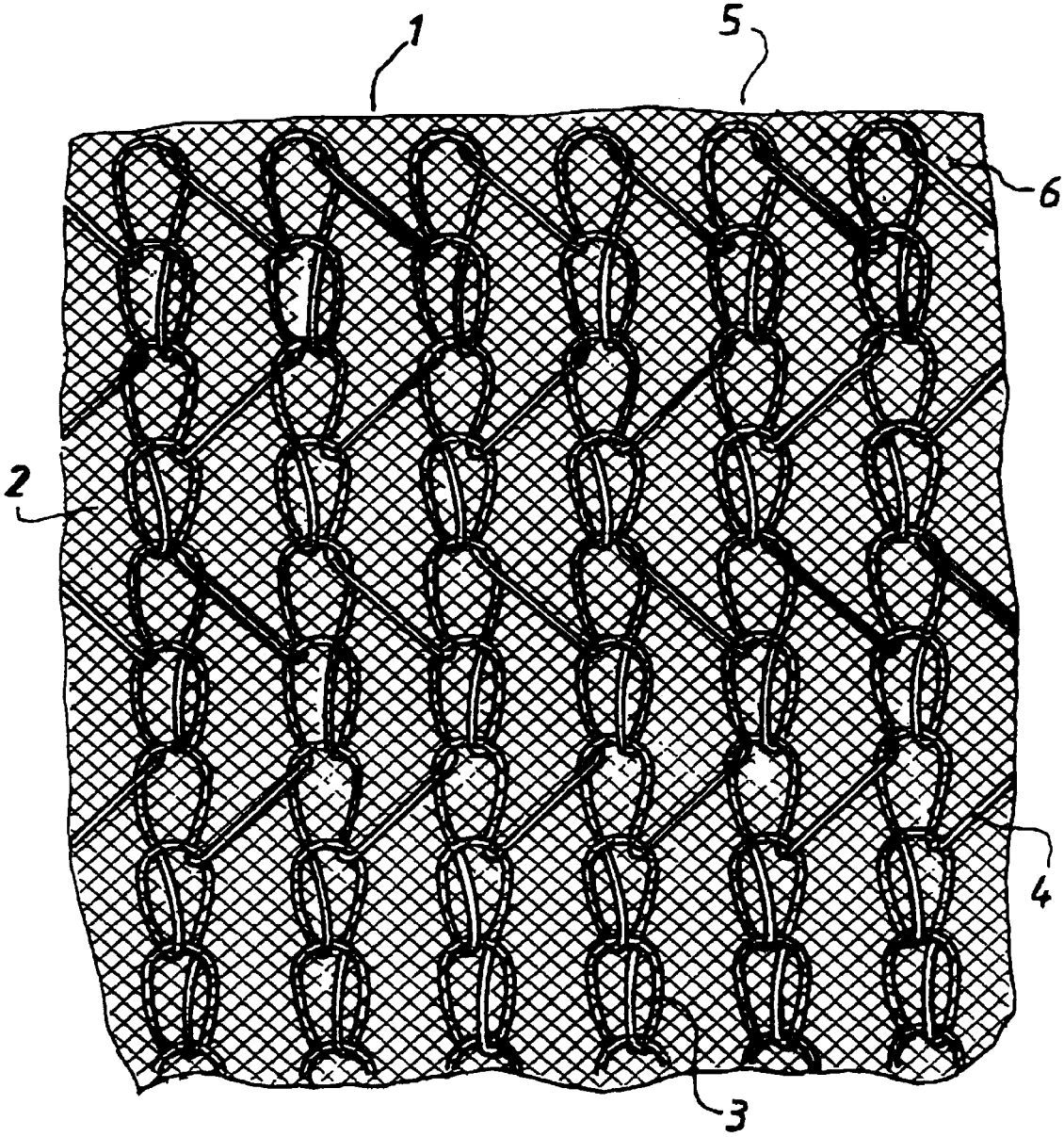

The invention relates to a textile support for reinforcing clothing or pieces of clothing.

The invention also relates to a method of manufacturing such a textile support, and to its applications.

Reinforcing textile supports are intended to give the required feel, flexibility and firmness to the clothing to which they are fixed.

U.S. Pat. No. 5,065,599 describes an interlining fabric which will facilitate the securing by basting of a second textile layer to the interlining. To this end, it proposes a fabric body which is warp knitted, and with floats at one surface thereof.

This document does not relate to an interlining incorporating a layer of nonwoven textile to meet the requirements in terms of weight and volume.

U.S. Pat. No. 3,992,904 describes a stitch-bonded nonwoven fabric comprising a web of fibers stitch-bonded by wales of chain stitch loops on one side of the fabric which are interconnected on the other side of the fabric by stitch laps.

This fabric is not suitable for reinforcing clothing but for furnishing, drape and dress.

Different proposals have already been made for producing thermobonding textile supports intended for interlining and incorporating a layer of nonwoven textile.

For example, FR-A-2 645 180 describes a product including a layer of nonwoven textile, a weft, a knitted thread ensuring the connection of the weft with the layer of nonwoven textile and a thermobonding adhesive layer.

The products proposed up until now do however not make it possible in all cases to meet the requirements in terms of weight, which must be low, volume which, on the other hand, must be high, firmness, elasticity and dimensional stability.

The invention therefore aims to remedy these drawbacks.

To this end, it proposes a textile support for reinforcing an item of clothing or pieces of clothing, in the form of a layer of nonwoven textile reinforced by one or more warp knit fabrics, the stitches of the knitted fabric or fabrics having floats on at least two columns of stitches.

According to other characteristics, the floats are produced on each row of stitches. As a variant, they are produced on one row of stitches out of two, or on one row of stitches out of three or four, or even more.

According to one embodiment, the textile support of the invention also comprises short-weft threads unwinding in the direction of the floats.

The short-weft threads do not participate in the formation of the stitch and their function is notably to increase the stability of the support.

According to yet another embodiment, the textile support of the invention also comprises a second warp knit fabric, the stitches of the second knitted fabric also having floats on at least two columns of stitches.

This second knitted fabric is preferably superimposed on the first knitted fabric and its function is notably to increase the volume of the textile support.

This second knitted fabric is produced from threads with compositions and/or yarn numberings identical to or different from those used for the first knitted fabric.

The second knitted fabric has floats identical to or different from those of the first knitted fabric.

For example, the first warp knit fabric has floats on two columns of stitches whilst the second warp knit fabric has floats on three columns of stitches.

The knitted fabric is produced from textured artificial or synthetic threads.

The textured synthetic threads comprise for example multifilament threads.

The number and yarn numbering per single ply of the filaments are generally chosen according to the resilience or elasticity, volume and flexibility required for the textile support. For example, the yarn numbering per single ply of the filaments can be between 1 decitex and 35 decitex.

The multifilament threads can comprise from 6 to 150 filaments.

The textures threads comprise for example threads of polyamide, notably polyamide 6 or 6.6, polyester or viscose and derivatives and/or mixtures of these products.

Texturing is obtained by using, for example, a conventional technique of texturing by false twisting or an air texturing technique.

The density of the knitted fabric is generally chosen according to the flexibility which it is wished to confer on the textile support and the yarn numbering of the threads used. The density of stitches is thus between 2 stitches per cm and 20 stitches per cm.

The invention also relates to a method of manufacturing a textile support intended for reinforcing clothing or pieces of clothing of the type in which:

- a lap of nonwoven textile is formed,
- the cohesion of the lap of nonwoven textile is reinforced with at least one warp knit fabric on a loom of the "warp" type the stitches of the knitted fabric having floats on at least two columns of stitches,
- the textile support thus obtained is finished, during which the knitted fabric undergoes contraction,
- optionally, a layer of thermobonding material is deposited on at least one of the faces of the textile support.

The invention also relates to the applications of the textile support of the invention, notably for the stiffening of clothing or pieces of clothing, such as jackets, shirt fronts, trousers, ties, shirts or the like, as well as clothing or pieces of clothing including at least one textile support according to the invention.

The invention will be clearly understood from the following description, given with reference to the accompanying drawings in which FIGS. 1 to 5 depict schematic flat elevation views of different embodiments of the textile support of the invention.

Referring now to the figures, the textile support 1 intended for reinforcing clothing or pieces of clothing includes a layer of nonwoven textile 2.

The role of this layer is principally to give to the textile support 1 a high volume compared with its weight.

It is produced from an only slightly compacted lap of continuous fibres or filaments and optionally undergoes a minimum degree of bonding in order to give cohesion to the fibres.

The bonding can consist for example of a thermal bonding, notably a hot bonding or prebonding. The bonding can also consist of a needling or preneedling.

Alternatively, the bonding can be carried out by water jets or chemical agent.

The techniques of bonding and prebonding are generally chosen according to the nature of the fibres or filaments used for the layer of nonwoven textile.

The layer of nonwoven textile 2 is produced from natural continuous fibres or filaments, such as cellulose or wool, from synthetic continuous fibres or filaments such as polyamide or polyester, or from artificial continuous fibres or filaments such as viscose, as well as the derivatives and/or mixtures of these products.

The fibres or filaments used for producing the layer of nonwoven textile 2 have for example a yarn numbering greater than 1 decitex.

According to another embodiment, the layer of nonwoven textile 2 is produced from microfibres or microfilaments with a yarn numbering less than 1 decitex.

The layer of nonwoven textile 2 generally has a weight varying from 15 to 100 g/m$^2$.

This layer of nonwoven textile 2 is reinforced with a knitted fabric 3 whose function is notably to reinforce the cohesion of the sheet of nonwoven textile, and to afford elasticity both in the weft direction and in the warp direction.

The knitted fabric 3 is a warp knit fabric, having floats 4 on at least two columns 5 of stitches.

The floats are obtained by passing the knitting threads over different needles of the loom, at each row of stitches (or at a given number of rows of stitches).

Figure 2:
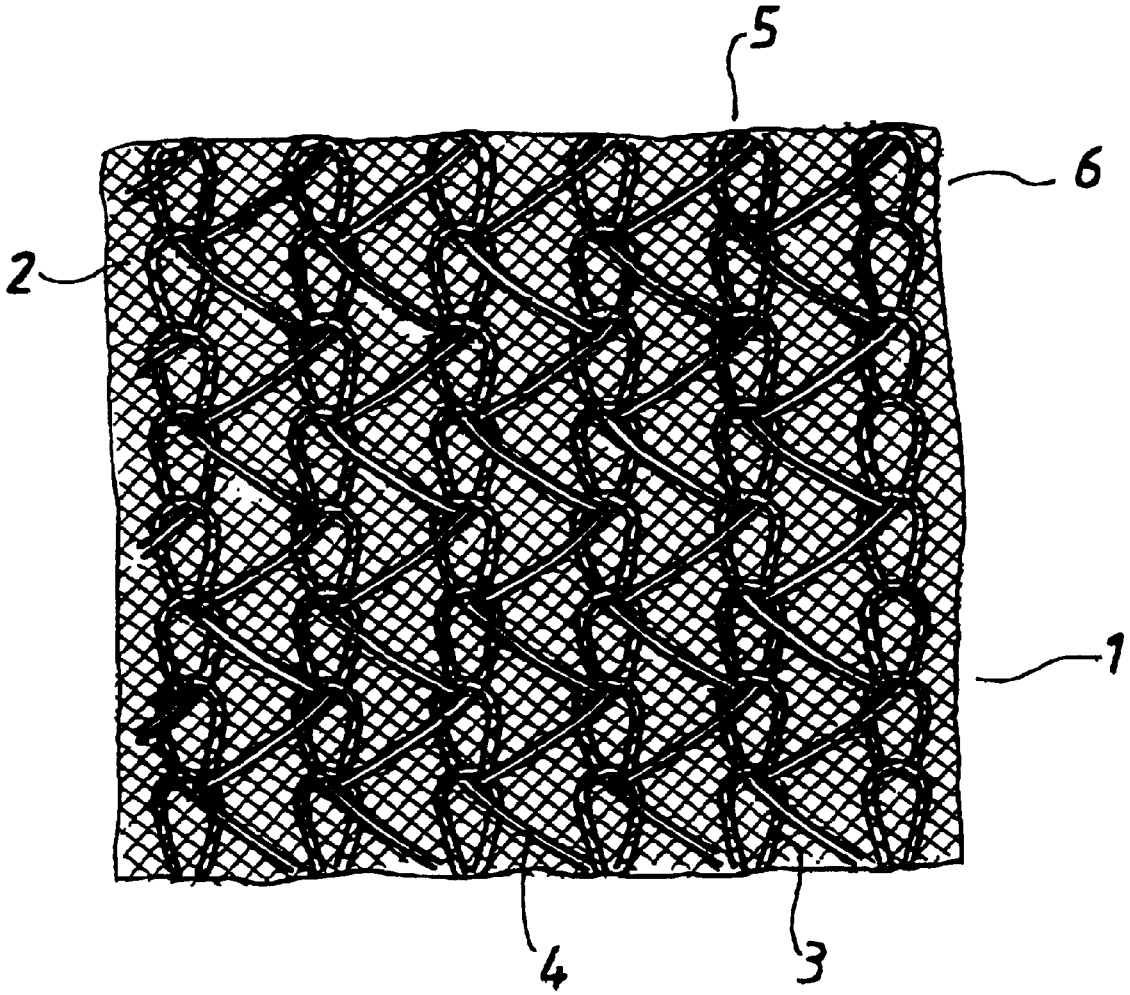
Figure 3:
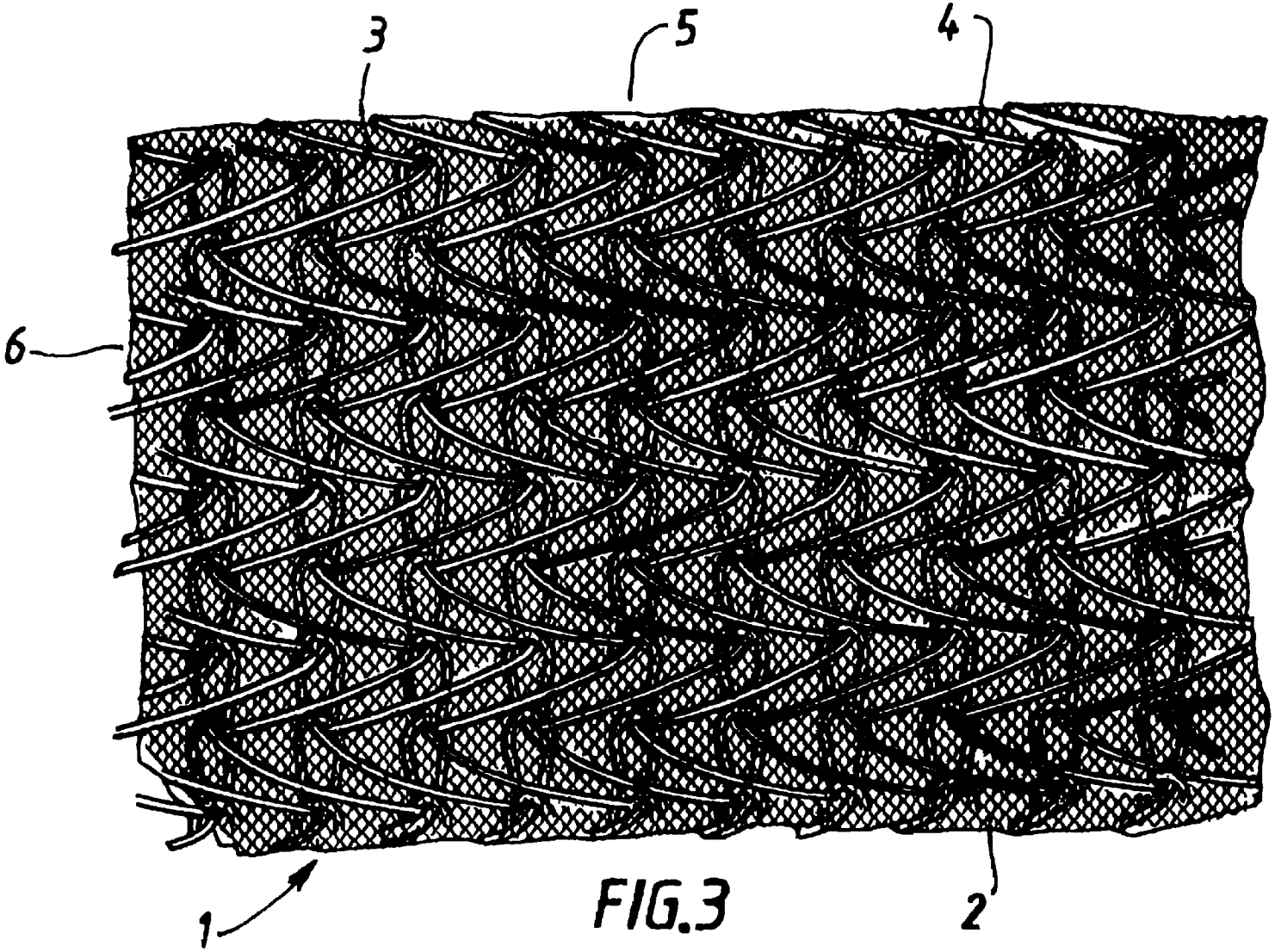
Figure 4:
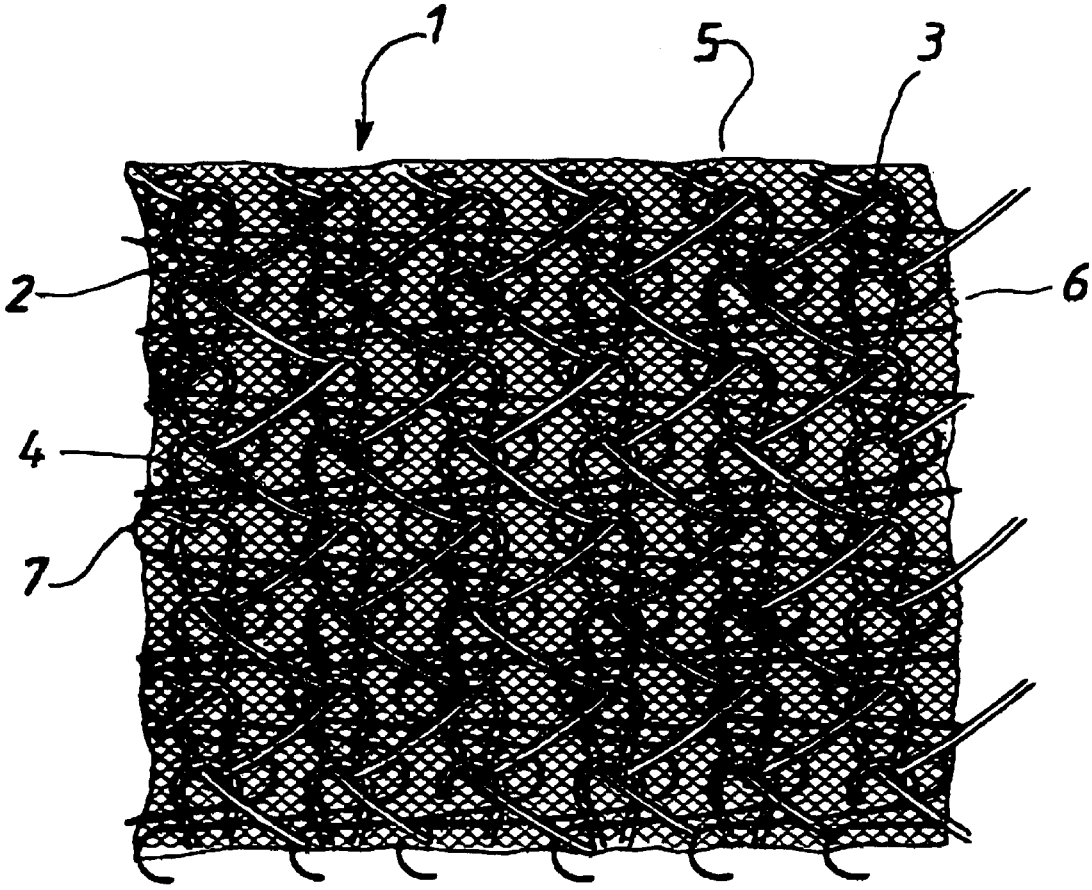

In the embodiments depicted in FIGS. 1, 2 and 4, the floats 4 are produced on two columns 5 of stitches. It can also be envisaged producing the floats on three, four or more columns of stitches. as depicted in FIG. 3.

According to one embodiment of the invention, the floats 4 are produced on each row 6 of stitches (FIGS. 2, 3, 4 and 5).

According to another embodiment, the floats 4 are produced on one row 6 of stitches out of two (FIG. 1).

It can also be envisaged producing a knitted fabric having floats on one row 6 of stitches out of three or four, or even more.

In the embodiment depicted in FIG. 4, the textile support 1 of the invention comprises in addition short-weft threads 7, unwinding in the direction of the floats.

In FIG. 4, the short-weft threads 7 unwind over two columns 5 of stitches.

It can also be envisaged disposing short-weft threads unwinding over three, four or more columns of stitches.

The short weft 7 is produced from mono- or multifilament, flat or textured, natural, synthetic or artificial threads, such as those described above.

Figure 5:
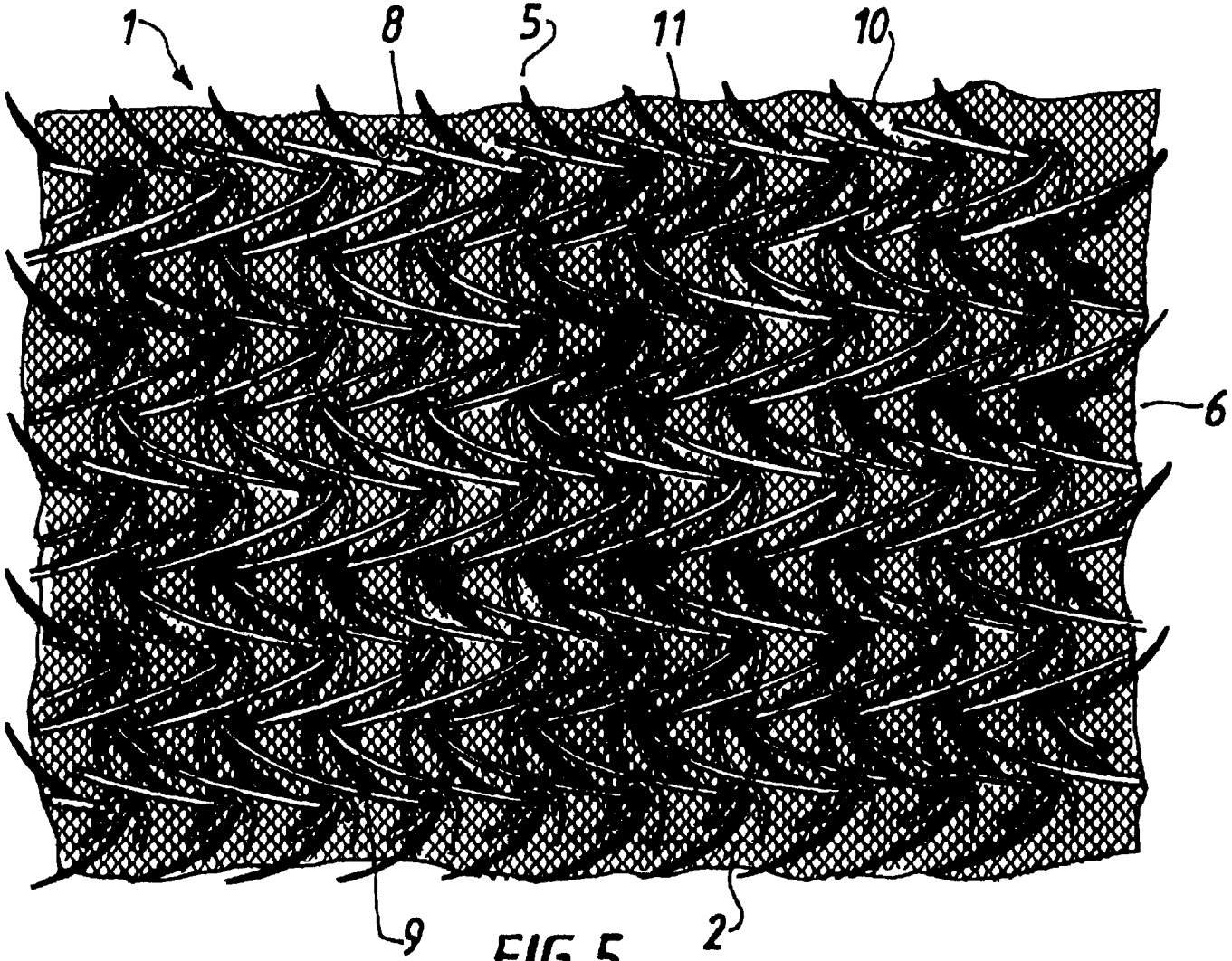

In the embodiment depicted in FIG. 5, the textile support 1 of the invention comprises two warp knit fabrics, each having floats on at least two columns of stitches.

A first warp knit fabric 8 is produced, having floats 9 on three columns 5 of stitches, every row 6 of stitches.

On this first knitted fabric 8 there is superimposed a second warp knit fabric 10, having floats 11 on two columns 5 of stitches, every row 6 of stitches.

According to one embodiment, the textile support of the invention comprises a thermobonding adhesive material. The thermobonding material constitutes a layer of adhesive and is chosen from amongst any of those normally used for ensuring the lamination of reinforcing fabric to textiles which are to receive them.

It is for example based on vinyl polymers, polyolefin, polyamide, high and low density polyethylene, copolyester, copolyamide, etc.

These substances can be in the form of powder or paste. The normal coating methods can be used, for example the methods of coating by printing of the screen printing type.

The adhesive layer can be deposited on at least one of the bases of the textile, in the form of points, double points or lines.

According to the method of the invention, a layer of nonwoven textile 2 is first of all formed.

Numerous methods of manufacturing nonwoven textile sheets are known per se. Any one of them can be used for producing the layer of nonwoven textile 2 of the textile support of the invention.

The layer 2 can have a bonding or prebonding, as described above. This bonding or prebonding can be carried out by the method described above, for example by producing a slightly needled or preneedled nonwoven textile layer.

A loom of the "RASCHEL" or "MALI" type is fed with this layer of nonwoven textile 2.

The operation of these types of loom is known per se. Generally, the nonwoven layer 2 is deposited between the needle bed and the fall plate. A needle co-operates in a known fashion with guide bars for producing the knitted fabric.

Thus the layer of nonwoven textile 2 is pierced by the needles of the loom and is therefore held by the knitted fabric.

Subsequently to this association and according to a variant embodiment, the threads of the knitted fabric undergo a contraction which gives rise to a decrease in the dimensions of the textile support produced.

The purpose of this contraction processing is to confer a curl and a volume, as well as an elastic capability, on the textile support.

The contraction reduces the dimensions of the layer of nonwoven textile, giving it a volume greater than that which it had initially. This method of associating a nonwoven lap and a contractable knitted thread makes it possible to obtain a textile support having good firmness both in the warp direction and in the weft direction, whilst preserving an extensibility determined by the conditions of the contraction treatment.

Preferably, the degree of extension of the threads of the knitted fabric, after contraction treatment, varies from 4 to 20%.

Since the contraction of the threads of the knitted fabric reduces the width and length of the layer of nonwoven textile 2, it therefore increases its mean thickness compressed during knitting and thereby its volume, imposing on the fibres a curling effect under the action of the contraction.

The contraction Of the fibres of the knitted fabric is produced, for example, with a conventional method of contraction by hot water, steam or hot air.

However, other means can be envisaged for producing this contraction.

The textile support is then subjected to the conventional finishing operations, and the contraction can take place during these finishing operations.

Next a layer of thermobonding coating is optionally deposited on the textile support. This coating is preferably a coating at points, produced for example with an engraving cylinder of the screen printing type.

What is claimed is:

1. A textile support for reinforcing clothing or pieces of clothing, in the form of a layer of nonwoven textile reinforced by one or more warp knit fabrics, the stitches of the knitted fabric or fabrics having floats on at least two columns of stitches.

2. The textile support according to claim 1, wherein the floats are effected on each row of stitches.

3. The textile support according to claim 1, wherein the floats are effected on one row of stitches.

4. The textile support according to claim 1, wherein the floats are produced on two columns of stitches.

5. The textile support according to claim 1, wherein the floats are produced on three or four columns of stitches, or more.

6. The textile support according to claim 1, wherein it comprises in addition short-weft threads, unwinding in the direction of the floats, without participating in the formation of the stitch.

7. The textile support according to claim 6, wherein the short weft is produced from mono- or multifilament, flat or textured, natural, synthetic or artificial threads.

8. The textile support according to claim 1, wherein it comprises a second warp knit fabric, the stitches of the second knitted fabric having floats on at least two columns of stitches.

9. The textile support according to claim 8, wherein the second knitted fabric is superimposed on the first knitted fabric.

10. The textile support according to claim 8, wherein the second knitted fabric is produced from threads with compositions and/or yarn numberings which are identical to or different from those of the first fabric.

11. The textile support according to claim 8, wherein the second knitted fabric has floats which are identical to or different from those of the first knitted fabric.

12. The textile support according to claim 1, wherein the knitted fabric is produced from textured synthetic or artificial threads.

13. The textile support according to claim 12, wherein the textured threads comprise multifilament threads.

14. The textile support according to claim 13, wherein the multifilament threads have a yarn numbering per single ply varying between 1 decitex and 35 decitex.

15. The textile support according to claim 13, wherein the multifilament threads comprise 6 to 150 filaments.

16. The textile support according to claim 12, wherein the threads comprise threads of polyamide, notably polyamide 6 or 6.6, polyester or viscose, and/or derivatives and mixtures of these products.

17. The textile support according to claim 1, wherein the layer of nonwoven textile is produced from continuous, natural, synthetic or artificial fibres or filaments.

18. The textile support according to claim 17, wherein the layer of nonwoven textile is produced from wool, cellulose, viscose, polyamide or polyester, as well as derivatives and/or mixtures thereof.

19. The textile support according to claim 18, wherein the layer of nonwoven textile is produced from microfibres or microfilaments with a yarn numbering less than 1 decitex.

20. The textile support according to claim 17, wherein the fibres or filaments used for producing the layer of nonwoven textile have a yarn numbering greater than 1 decitex.

21. The textile support according to claim 17, wherein the layer of nonwoven textile has a weight varying from 15 to 100 $g/m^2$.

22. The textile support according to claim 1, wherein the stitch density of the knitted fabric is between 2 stitches per cm and 20 stitches per cm.

23. The textile support according to claim 1, wherein the threads of the knitted fabric undergo a contraction treatment.

24. The textile support according to claim 1, wherein the threads of the knitted fabric have a degree of elongation, after contraction, varying between 4 and 20%.

25. The textile support according to claim 1, wherein it comprises a thermobonding adhesive material.

26. The textile support according to claim 25, wherein the adhesive material is based on polyvinyl polymers, polyamide, polyolefin high and low density polyethylene, copolyester or copolyamide.

27. The textile support according to claim 25, wherein the adhesive material is deposited on at least one of the faces of the textile support in the form of points, double points or lines.

* * * * *